US006024067A

United States Patent [19]

Takachi et al.

[11] Patent Number: 6,024,067

[45] Date of Patent: Feb. 15, 2000

[54] ASSEMBLY FOR DIRECT CONNECTION OF INTERNAL COMBUSTION ENGINE AND MACHINE DRIVEN

[75] Inventors: Ken Takachi, Nishinomiya; Shuji Ogai, Osaka, both of Japan

[73] Assignee: Longwell Japan Co., Ltd., Osaka, Japan

[21] Appl. No.: 09/117,540

[22] PCT Filed: Dec. 9, 1996

[86] PCT No.: PCT/JP96/03604

§ 371 Date: Oct. 29, 1998

§ 102(e) Date: Oct. 29, 1998

[87] PCT Pub. No.: WO98/26165

PCT Pub. Date: Jun. 18, 1998

[51] Int. Cl.[7] ..... F02B 75/24

[52] U.S. Cl. ..... 123/197.1; 123/197.4

[58] Field of Search ..... 123/197.1, 197.2, 123/197.3, 197.4, 197.5

[56] References Cited

U.S. PATENT DOCUMENTS

| | | | |
|---|---|---|---|
| 3,886,805 | 6/1975 | Koderman | 123/197.4 |
| 4,026,252 | 5/1977 | Wrin | 123/197.4 |
| 5,394,839 | 3/1995 | Haneda | 123/197.4 |
| 5,465,648 | 11/1995 | Cy | 123/197.4 |
| 5,799,636 | 9/1998 | Fish | 123/197.4 |

*Primary Examiner*—Marguerite McMahon
*Attorney, Agent, or Firm*—Nikaido, Marmelstein, Murray & Oram LLP

[57] ABSTRACT

The invention is intended to connect a various kinds of movable bodies capable of reciprocating in linear fashion, such as a piston of a compressor, directly to a piston of an internal combustion engine, for effecting efficient power transmission.

A cylinder 4*a* of an internal combustion engine E and a cylinder 4*b* of a compressor C are arranged in alignment with each other along a rectilinear line. An internal sun gear 8*a* is fixedly arranged, which has a center O at a position intermediate the internal combustion engine E and the compressor C on the rectilinear line. A planetary gear 10 is arranged, which is meshed with the internal sun gear 8*a* for rotation about its center and for revolution around the center O. The planetary gear 10 has a pitch circle diameter half that of the internal sun gear 8*a*. A crank member 14 is arranged, which includes a shank 14*a* rotatable about the center O. The planetary gear 10 is rotatably supported, at its center, by the tip of the arm 14*b* of the crank member 14. A connecting rod 6 is arranged, which connects the piston 2*a* and 2*b* with each other. The connecting rod 6 is pivotally connected, at its central portion, to a shank 12 on the peripheral side surface of the planetary gear 10.

4 Claims, 4 Drawing Sheets

ASSEMBLY FOR DIRECT CONNECTION OF INTERNAL COMBUSTION ENGINE AND MACHINE DRIVEN

FIELD OF THE INVENTION

This invention is intended to connect a various kinds of movable bodies reciprocating in linear fashion, such as a piston of a compressor, directly to a piston of an internal combustion engine, so as to cause the movable bodies to be driven.

BACKGROUND OF THE INVENTION

A crank device is known in the art as a means for performing power conversion between reciprocating motion and rotational motion in an internal combustion engine or a compressor. It is noted, however, that such a crank device presents loss in efficiency of power conversion, since a connecting rod coupling a piston and a crankshaft is always inclined relative to the cylinder axis except when the connecting rod is at the top dead center or the bottom dead center of the piston. It is also noted that a phenomenon called "piston slap" is caused in which the piston rubs against the inner wall of the cylinder due to a lateral component of force applied from the connecting rod to the piston as a reaction force. This causes vibration, noise and wearing.

It is noted, however, that employment of prior art crank device is unavoidable when it is intended to drive a driven machine including a movable body reciprocating in linear fashion, such as a piston of a compressor, using an internal combustion engine as a power source. FIG. 4 illustrates three types of coupling mechanisms between an internal combustion engine E and a compressor C. In FIGS. 4(*a*) and (*b*), each of the internal combustion engine E and the compressor C includes a crank device. In the coupling mechanism shown in FIG. 4(*a*), a rotational motion is transmitted by means of pulleys 50*a* and 50*b* and a belt 51. In the coupling mechanism shown in FIG. 4(*b*), a rotational motion is transmitted by means of a coupling 52. In the coupling mechanism shown in FIG. 4(*c*), a common crank device 53 is disposed at a position where the cylinder axes of the engine E and the compressor C intersect with each other. In this case, the internal combustion engine E and the compressor C share a common crank pin 54.

The above-mentioned three coupling mechanisms all present significant loss during power conversion, since they employ a crank device.

In order to eliminate the disadvantages in prior art crank device mentioned above, the inventors have proposed a new crank device based on a new concept (Japanese Patent Application No. 6-121776 (Hei-6-121776). According to the new crank device, a planetary gear mechanism is interposed between a connecting rod and a crankshaft, so as to allow lateral amplitude caused at the lower end of the connecting rod in response to rotation of crankshaft to be accommodated by the planetary gear mechanism. By this, the connecting rod is always moved up and down along the cylinder axes, without causing any rocking motions, whereby efficiency in power conversion may be increased and undesirable phenomenon of piston slap may be eliminated.

SUMMARY OF THE INVENTION

It is an object of the invention to suitably apply the new crank device, so as to connect a various kinds of movable bodies reciprocating in linear fashion, such as a piston of a compressor, directly to a piston of an internal combustion engine, for achieving efficient power transmission.

In order to achieve the above-mentioned object, an assembly of an internal combustion engine and a driven machine directly coupled with each other according to the invention comprises:

an internal combustion engine having a piston capable of reciprocating in linear fashion and a driven machine having a movable body capable of reciprocating in linear fashion, the piston of the internal combustion engine and the movable body of the driven machine being arranged in alignment with each other along a rectilinear line;

a fixedly mounted internal sun gear having its center o at a point intermediate the internal combustion engine and the driven machine on the rectilinear line;

a planetary gear being meshed with the internal sun gear for rotation about its center and for revolution around the center of the internal sun gear, the planetary gear having a pitch circle diameter half that of the internal sun gear;

a crank member including an arm supporting the planetary gear at its central portion for rotation about its center and a shank supported for rotation about the center O so as to allow revolution of the planetary gear around the center O; and a connecting rod extending between the piston of the internal combustion engine and the movable body of the driven machine along the rectilinear line, so as to connect the piston and the movable body with the outer periphery of the planetary gear in pivotable fashion.

In the assembly according to the invention, it is important to maintain static and dynamic weight balance about the center of the planetary gear, as well as static and dynamic weight balance about the shank of the crank member, in order to avoid occurrence of vibration and in order to achieve efficient power transmission.

It is advantageous for the arm of the crank member to be rotatably accommodated within the space inside the internal sun gear excluding the space of the planetary gear, in order to construct the assembly of the invention in compact fashion.

In the assembly of an internal combustion engine and a driven machine directly coupled with each other according to the invention, and when the internal combustion engine is operated, linear reciprocating motion of the piston of the internal combustion engine is transmitted, through the connecting rod, directly to the movable body of the driven machine. Thus, the movable body is reciprocated in linear fashion in a way quite the same as that of the piston. Accordingly, any component of force due to the phenomenon of piston slap, as experienced in prior art crank device, will not be created. The planetary gear is rotated about its center, while, at the same time, revolving around the center of the internal sun gear along the internal sun gear. Thus, the crank member is rotated in accordance with the revolution of the planetary gear. The crank member simply supports the planetary gear for rotation about its center and for revolution around the center of the internal sun gear, and is not subjected to any other special loads. Accordingly, quite high efficiency in power transmission from the piston to the movable body is obtained. It is also noted that a flywheel effect is generated from the inertia of revolution of the planetary gear and the inertia of rotation of the crank member, so that downward movement and upward movement of the piston of the internal combustion engine and the movable body of the driven machine from their respective top dead center and bottom dead center, respectively, may be smoothly performed.

BRIEF DESCRIPTION OF THE DRAWINGS

For a fuller understanding of the nature and objects of the present invention, reference should be had to the following detailed description taken in connection with the accompanying drawings wherein.

BEST MODE FOR CARRYING OUT THE INVENTION

Figure 1:
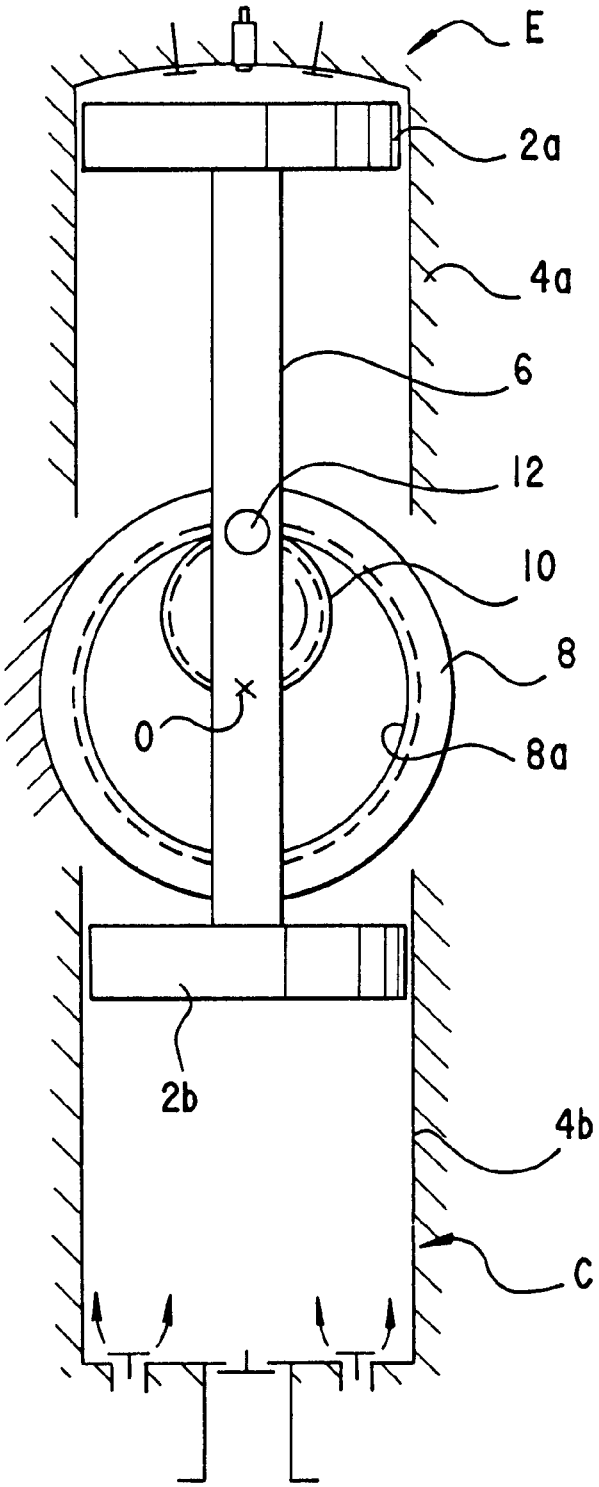
FIG. 1 is a schematic view, in longitudinal section, of an internal combustion engine/compressor assembly.
Figure 2:
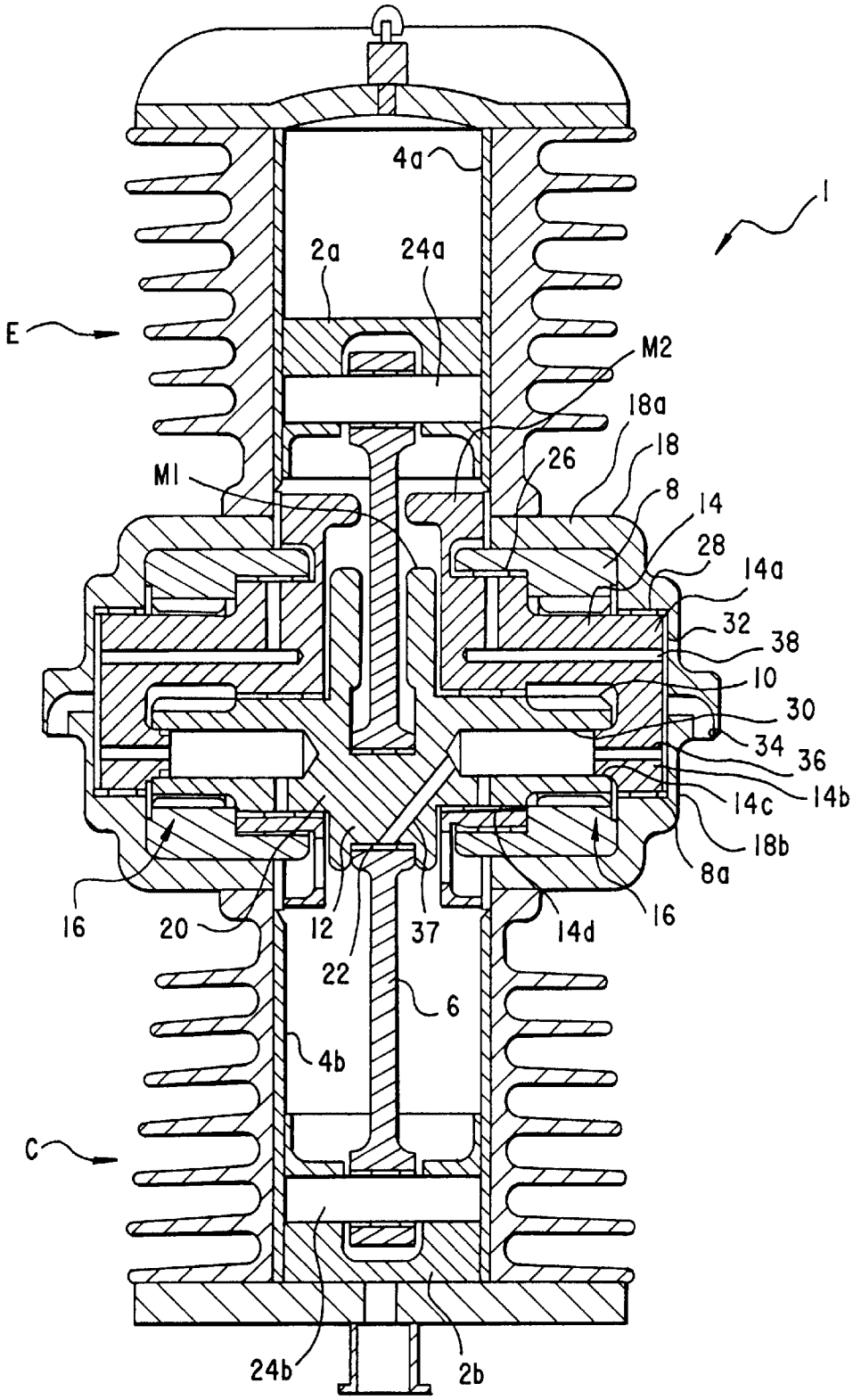
FIG. 2 is a realistic view,in longitudinal section, of the internal combustion engine/compressor assembly.

One embodiment, in which the invention is applied to an internal combustion engine/compressor assembly 1, will be explained below with reference to FIGS. 1 through 3. The assembly 1 is constructed so as to transmit a linear reciprocating motion of a piston 2*a* of an internal combustion engine E directly to a piston (movable body) 2*b* of a compressor (driven machine), so as to cause a linear reciprocating motion of the piston 2*b* of the compressor C. To this end, a cylinder 4*q* of the internal combustion engine E and a cylinder 4*b* of the compressor C are so arranged that their axes are aligned on a straight line. It is also noted that the piston 2*a* of the internal combustion engine E and the piston 2*b* of the compressor C are integrally connected with each other by means of a connecting rod 6.

An internal sun gear 8*a* is fixedly disposed at a position intermediate the internal combustion engine E and the compressor C. The internal sun gear 8*a* has its center O on the aligned axes of the cylinders 4*a* and 4*b*. The internal sun gear 8*a* is meshed with a planetary gear 10 having a pitch circle diameter half that of the internal sun gear 8*a*. The connection rod 6 is connected, at its intermediate portion, to a shank 12 arranged, at its one end surface, in flush with the circumferential side surface of the planetary gear 10. The shank 12 may be fixedly connected to the connecting rod 6, as long as the shank 12 is rotatably mounted relative to the planetary gear 10. The shank 12 is normally disposed just at the intermediate position of the length of the connecting rod 6, so as to construct the assembly 1 in a compact manner. It is noted, however, that the shank 12 may be disposed on the connecting rod 6 at a position slightly offset toward either one end of the connecting rod 6. The connecting rod 6 may be formed as an integral body. Alternatively, the connecting rod 6 may be separated at a portion on which the shank 12 is mounted, for the purpose of accommodating, for example, allowable error during assembling. In this case, one piston 2*a* and the shank 12 are connected together by means of a first connecting rod, while the other piston 2*b* and the shank 12 are connected together by means of a second connecting rod.

Figure 3:
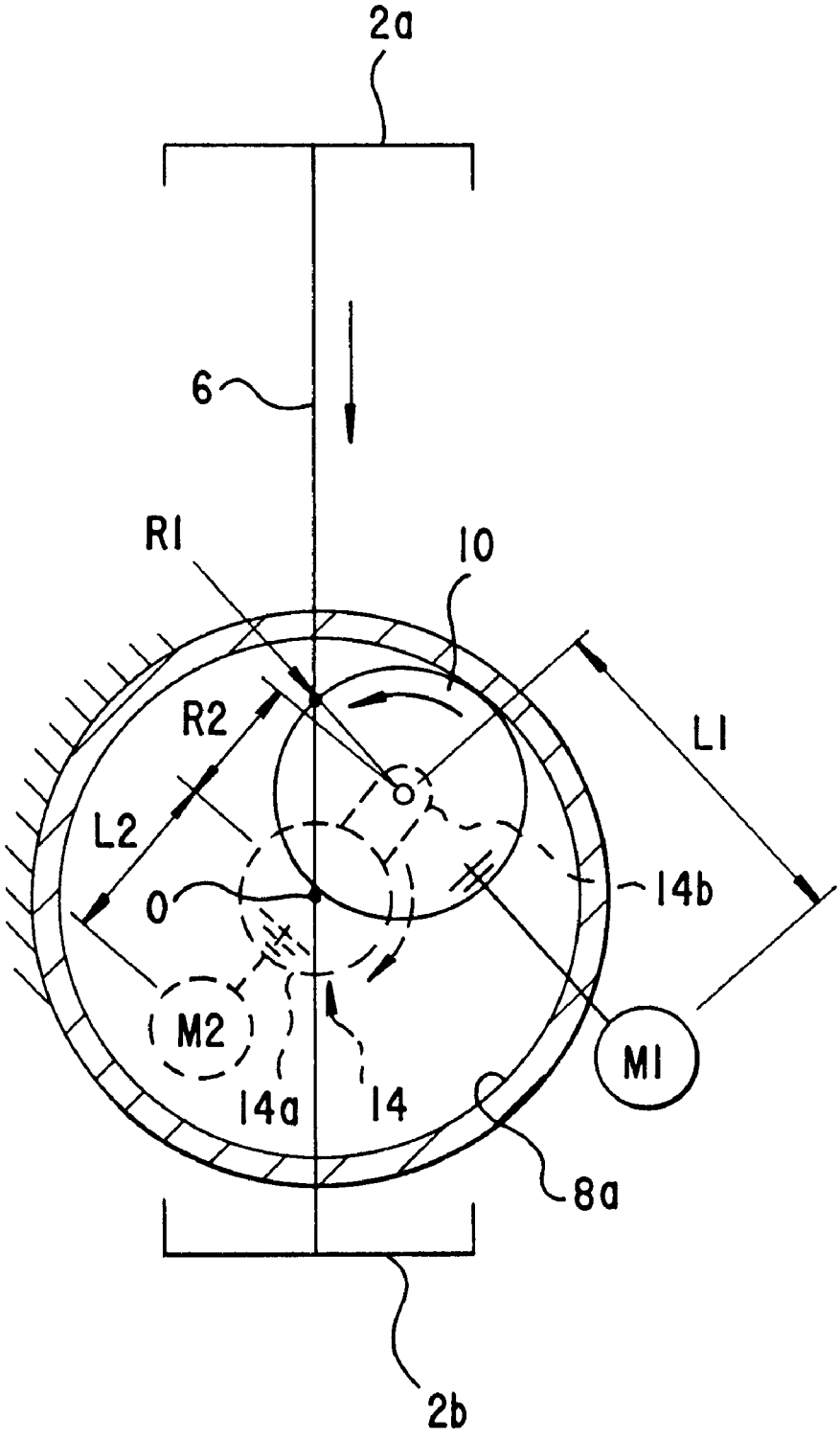
FIG. 3 is a constructive view illustrating weight balance of the internal combustion engine/compressor assembly.
Figure 4A:
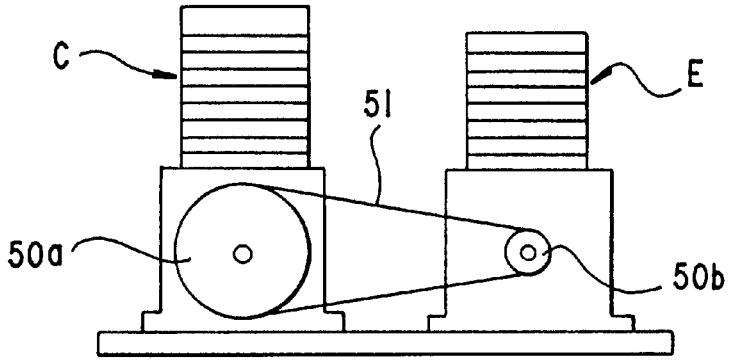
FIGS. 4(*a*), (*b*) and (*c*) are schematic views showing three types of mechanisms for transmitting power between the internal combustion engine and the compressor.
Figure 4B:
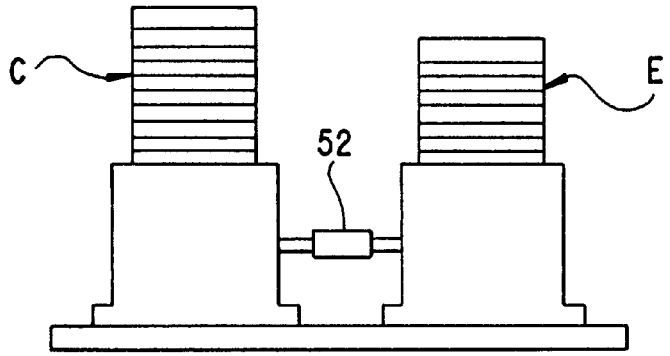
Figure 4C:
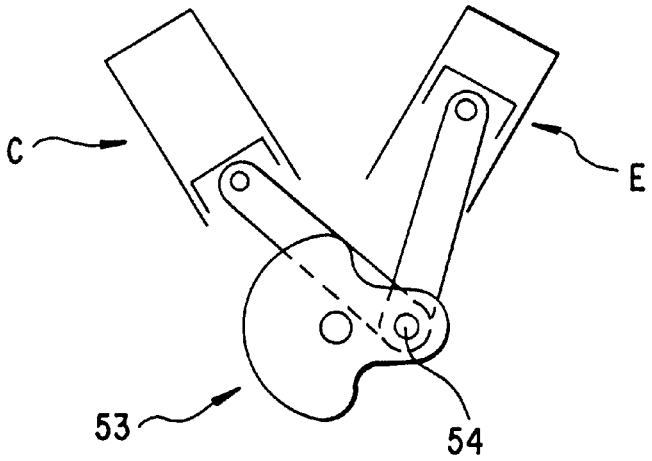

The planetary gear 10 is rotatably supported, at its central portion, on the forward end portion of an arm 14*b* of a crank member 14 having a shank 14*a* centered at the center O of the internal sun gear 8*a*, as shown in FIG. 3. The crank member 14 extends in a direction perpendicular to the sheet of the drawing as viewed in FIGS. 1 through 3. The crank member 14 supports the planetary gear 10 so as to allow the planetary gear 10 within the internal sun gear 8*a* to be rotated about its center and to be revolved around the center O of the internal sun gear 8*a*.

The basic construction of the internal combustion engine/compressor assembly 1 has been explained in the above. The basic construction of the internal combustion engine/compressor assembly 1 will be explained more particularly with reference to FIG. 2. FIG. 2 shows a pair of planetary gear mechanisms 16 and 16, each consisting of an internal sun gear 8*a* and a planetary gear 10, disposed on opposite sides (left-hand side and right-hand side) of the connecting rod 6. In this connection, only one planetary gear mechanism 16 may be arranged on one side of the connecting rod 6. It is noted, however, that mechanical stability of the assembly 1 may be significantly increased by providing the pair of left-hand side and right-hand side planetary gear mechanisms 16, as mentioned above. A housing 18 including a cylindrical portion 18*a* is disposed between the cylinder 4*a* of the internal combustion engine E and the cylinder 4*b* of the compressor C. The internal sun gear 8 is fixedly fitted, at its outer periphery, within the housing 18 along its inner periphery.

The sun gear member 8 is of a ring-like or annular configuration. The internal sun gear 8*a* is formed in the inner periphery of the sun gear member 8 at the upper or lower portion thereof. A planetary gear 10 is meshed with the internal sun gear 8*a* for rotation about its center and for revolution around the center O of the internal sun gear 8*a*. The planetary gear 10 has a pitch circle diameter half that of the internal sun gear 8*a*. The planetary gear 10 is integrally connected with the opposite planetary gear through a curved shank 20. An axial bore 22 formed in the intermediate portion of the connecting rod 6 is pivotally supported for rotation by means of a shank 12 formed on the curved shank 20 at its intermediate point. Pistons 2*a* and 2*b* are mounted on the connecting rod 6 at its opposite ends to by means of piston pins 24*a* and 24, respectively. It is noted that the curved shank 20 is provided, on the surface opposite to the shank 12, with a counter weight M1 formed integrally therewith. The counter weight M1 extends radially outward of the curved shank 20.

A bearing 26 is provided in the inner periphery of the internal sun gear member 8 at a position adjacent to the internal sun gear 8*a*, in order to rotatably support a crank member 14. The crank member 14 is disposed in the inner space of the internal sun gear 8*a*, so as to enclose the planetary gear 10 therein. The crank member 14 is rotatably supported, at one outer periphery thereof, by means of the bearing 26. The crank member 14 is also rotatably supported, at the other outer periphery thereof, by means of a separate bearing 28 provided on the inner periphery of the housing 18.

The planetary gear 10 is formed, at its center, with a axial bore 30. The axial bore 30 also serves as an oil hole. A spindle portion 14*c* protruding from the crank member 14 is rotatably fitted within the axial bore 30. The outer periphery of the curved shank 20 adjacent to the planetary gear 10 is rotatably supported by a bearing 14*d* provided on the crank member 14. The crank member 14 is integrally formed with a counter weight M2. The counter weight M2 extends radially outward from the side of the crank member 14 opposite to the arm 14*b*.

The counter weights M1 and M2 will be explained below. First, the counter balance M1 is provided for the purpose of maintaining static and dynamic weight balance about the axial bore 30 of the planetary gear 10 as a center (i.e., the weight balance for the planetary gear 10 during its rotation about the center thereof). Thus, M1 is determined so as to satisfy: $A \times R1 + M1 \times L1$, wherein L1 is a distance from the center of the planetary gear 10 to the center of gravity of the counter weight M1 (see FIG. 3), A is a weight of the pistons 2*a* and 2*b* including the connecting rod 6, and R1 is a radius of the planetary gear 10. Secondly, the counter weight M2 is provided for the purpose of maintaining static and dynamic weight balance about the shank 14*a* as a center (i. e., the weight balance for the planetary gear 10 during its revolution around the center of the internal sun gear 8*a*). Thus, M2 is determined so as to satisfy: B×R2+M2×L2, wherein L2 is a distance from the shank 14*a* of the crank member 14 to the center of gravity of the counter weight M2, B is a weight of the planetary gear 10 and the arm 14*b* of the crank member 14 plus the above-mentioned weight A, and R2 is a distance from the center O of the shank 14*a* of the crank member 14 to the tip of the arm 14*b* of the crank member 14.

In order to reduce the balance weight M1 in the first balancing equation, it is necessary for the mass of the curved shank 20 to be positioned away from the rotational center of the planetary gear 10 as far as possible. Alternatively, it is necessary for the distance L1 to be extended. Likewise, and in order to reduce the counter weight M2, it is necessary for the mass of the crank shaft 14 to be positioned away from the revolutional center of the planetary gear 10 as far as possible. Alternatively, it is necessary for the distance L2 to be extended. It is noted, however, that each of the distances L1 and L2 should be maintained within a suitable range of size, since extension of the distance L1 and L2 may give significant influence on the outside dimension of the assembly 1.

The opposite ends of the housing 18 are closed by a respective end wall portion 18*b*, such that the opposite end surfaces of the crank member are enclosed with a gap therebetween, thus forming an oil supply port 34 on each of the end wall portion 18*b*. Each of the oil supply port 34 is in communication with the oil holes 36 and 38 of the crank member 14. Thus, lubrication relative to the outer peripheral surface of the shank 12 for supporting the connecting rod 6 is performed through one oil hole 36, the axial bore 30 and the oil hole 37 of the curved shank 20. Lubrication relative to the bearing 26 and 28 for supporting the crank member 14 is performed through the other oil hole 38 and the gas 32.

One embodiment of the invention has been explained, with reference to an exemplified internal combustion engine/compressor assembly 1. It is noted, however, that the present invention may be applied to any driven machines having a movable body reciprocating in-linear fashion, in place of a compressor. The invention may be applied for example to a vibrating ground compactor.

As will be appreciated from the foregoing, the invention is constructed so as to transmit a linear reciprocating motion of a piston of an internal combustion engine directly to a movable body of a driven machine through a connecting rod, so as to cause the movable body to be reciprocated in linear fashion. Thus, it is possible to restrict or eliminate loss in efficiency, vibration or noise due to piston slap and the like, as experienced in prior art power transmission mechanism employing a crank device, thus realizing quite efficient and silent power transmission. It is also noted that installation space may be greatly reduced by arranging the assembly of the invention in a vertical direction, since the internal combustion engine and the driven machine are linearly arranged.

Further, prevention of vibration and improved power transmission efficiency may be achieved by maintaining static and dynamic weight balance about the central portion of the planetary gear, as well as static and dynamic weight balance about the shank of the crank member.

Furthermore, the arm of the crank member may be rotatably accommodated within the space inside the internal sun gear, excluding the space for the planetary gear, so that the assembly according to the invention may be constructed in compact fashion.

It will further be obvious to those skilled in the art that many variations may be made in the above embodiments, here chosen for the purpose of illustrating the present invention, and full result may be had to the doctrine of equivalents without departing from the scope of the present invention, as defined by the appended claims.

We claim:

1. An assembly of an internal combustion engine and a driven machine directly coupled with each other comprising:

an internal combustion engine having a piston capable of reciprocating in linear fashion and a driven machine having a movable body capable of reciprocating in linear fashion, the piston of the internal combustion engine and the movable body of the driven machine being arranged in alignment with each other along a rectilinear line;

a fixedly mounted internal sun gear having its center O at a point intermediate the internal combustion engine and the driven machine on the rectilinear line;

a planetary gear being meshed with the internal sun gear for rotation about its center and for revolution around the center of the internal sun gear, the planetary gear having a pitch circle diameter half that of the internal sun gear;

a crank member including an arm supporting the planetary gear at its central portion for rotation about its center and a shank supported for rotation about the center O so as to allow revolution of the planetary gear around the center O; and a connecting rod extending between the piston of the internal combustion engine and the movable body of the driven machine along the rectilinear line, so as to connect the piston and the movable body with the outer periphery of the planetary gear in pivotable fashion.

2. The assembly of an internal combustion engine and a driven machine directly coupled with each other according to claim 1, wherein static and dynamic weight balance about the central portion of the planetary gear, as well as static and dynamic weight balance about the shank of the crank member, is maintained.

3. The assembly of an internal combustion engine and a driven machine directly coupled with each other according to claim 1, wherein the arm of the crank member is accommodated within the space inside the internal sun gear excluding the space of the planetary gear.

4. The assembly of an internal combustion engine and a driven machine directly coupled with each other according to claim 1, wherein the movable body of the driven machine capable of reciprocating in linear fashion is a compressor.

* * * * *